US009739437B2

(12) United States Patent
Otsubo

(10) Patent No.: US 9,739,437 B2
(45) Date of Patent: Aug. 22, 2017

(54) VEHICULAR LAMP UNIT

(71) Applicant: KOITO MANUFACTURING CO., LTD., Tokyo (JP)

(72) Inventor: Takayuki Otsubo, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 43 days.

(21) Appl. No.: 14/478,545

(22) Filed: Sep. 5, 2014

(65) Prior Publication Data

US 2015/0062948 A1 Mar. 5, 2015

(30) Foreign Application Priority Data

Sep. 5, 2013 (JP) ..... 2013-183579

(51) Int. Cl.
*F21V 7/00* (2006.01)
*F21S 8/10* (2006.01)

(52) U.S. Cl.
CPC ..... *F21S 48/1104* (2013.01); *F21S 48/1159* (2013.01); *F21S 48/1305* (2013.01); *F21S 48/137* (2013.01); *F21S 48/1317* (2013.01); *F21S 48/145* (2013.01); *F21S 48/1747* (2013.01)

(58) Field of Classification Search
CPC ..... F21S 48/17; F21S 48/1747
USPC ..... 362/538, 545
See application file for complete search history.

(56) References Cited

U.S. PATENT DOCUMENTS 6,286,984 B1 * 9/2001 Berg ..... F21S 48/215 362/227
8,616,741 B2 * 12/2013 Ookubo ..... F21S 48/1159 362/507
9,175,823 B2 * 11/2015 Yamamoto ..... B60Q 1/0041
(Continued)

FOREIGN PATENT DOCUMENTS

EP 2366938 A1 9/2011
EP 2570716 A1 3/2013
(Continued)

OTHER PUBLICATIONS

Extended European Search Report issued in corresponding European Application No. 14183538.9, mailed on Jan. 23, 2015 (6 pages).

*Primary Examiner* — Bryon T Gyllstrom
(74) *Attorney, Agent, or Firm* — Osha Liang LLP

(57) ABSTRACT

A vehicular lamp unit has a substrate, a light source having a first light-emitting element and a second light-emitting element disposed on the substrate, and an optical element having the light source attached thereto. The substrate is long in a first direction. The optical element radiates emitted light of the first and second light-emitting elements toward a front of the vehicular lamp unit, with a desired light distribution. A reference portion serving as a positioning reference for the optical element is provided in a part of the substrate. The first and second light-emitting elements are arranged in the first direction. The first light-emitting element illuminates an area having high light intensity of the light distribution. The second light-emitting element illuminates an area having low light intensity of the light distribution. The first light-emitting element is mounted at a position closer to the reference portion in the first direction than the second light-emitting element.

9 Claims, 7 Drawing Sheets

(56) References Cited

U.S. PATENT DOCUMENTS

| | | | | |
|---|---|---|---|---|
| 2003/0198060 | A1* | 10/2003 | Ishida | F21S 48/1159 362/516 |
| 2004/0008516 | A1* | 1/2004 | Amano | F21S 48/215 362/300 |
| 2004/0125614 | A1* | 7/2004 | Ishida | B60Q 1/04 362/509 |
| 2004/0252517 | A1* | 12/2004 | Ishida | F21S 48/1159 362/465 |
| 2005/0088853 | A1* | 4/2005 | Yatsuda | F21S 48/1154 362/545 |
| 2010/0110716 | A1* | 5/2010 | Nakada | F21S 48/1159 362/538 |
| 2011/0170307 | A1* | 7/2011 | Ishikawa | B60Q 1/2665 362/516 |
| 2012/0113659 | A1 | 5/2012 | Hermitte et al. | |
| 2013/0215632 | A1 | 8/2013 | Jackl et al. | |
| 2013/0272009 | A1* | 10/2013 | Fujiu | B60Q 1/0058 362/517 |

FOREIGN PATENT DOCUMENTS

| | | | |
|---|---|---|---|
| JP | 2011-165651 | A | 8/2011 |
| WO | 2012048351 | A1 | 4/2012 |
| WO | 2012059852 | A1 | 5/2012 |

* cited by examiner

VEHICULAR LAMP UNIT

BACKGROUND

Technical Field

The present invention relates to lamps in which a light source is formed by mounting a plurality of semiconductor light-emitting elements such as light-emitting diodes (LEDs) on a substrate, and more particularly to vehicular lamp units that are used for headlamps (headlamps) that form desired light distribution with high accuracy.

Related Art

Vehicular lamps such as taillights and headlamps of recent automobiles use semiconductor light-emitting elements such as LEDs as a light source in order to achieve power saving or high durability. For example, Patent Document 1 proposes a turn signal lamp using LEDs as a light source. However, since the amount of light emission of LEDs is smaller than that of bulbs (electric bulbs), a light source is sometimes formed by a plurality of LEDs in order to obtain the amount of light required for the lamp. In Patent Document 1, a plurality of LEDs are mounted on a single substrate, and this substrate is placed in a lamp housing, thereby ensuring a required amount of light and achieving reduction in size.

Patent Document 1

Japanese Patent Application Laid-Open (Kokai) No. 2011-165651

SUMMARY

In the case where a light source of a vehicular lamp is formed by mounting a plurality of LEDs on a single substrate as described above, accuracy of the mount positions of the LEDs on the substrate is better if such a light source is formed as a light source of the turn signal lamp of Patent Document 1, a taillight, or any other so-called marker lamps. That is, regarding the light distribution pattern and the light intensity distribution in the light distribution, accuracy required for the marker lamps is not as high as that required for headlamps. Accordingly, even if light distribution accuracy of the marker lamps reduces due to a small error of the mount positions of the LEDs on the substrate, the reduced light distribution accuracy often falls within an allowable range.

However, if such a light source is formed as a light source of a headlamp, the accuracy of the mount positions of the plurality of LEDs on the substrate matters because high accuracy is required for the light distribution of headlamps. That is, if there is an error of the mount positions of the LEDs on the substrate when the substrate of the light source is attached to an optical member such as a reflector or an illumination lens, this error leads to reduction in light distribution accuracy of the headlamp, and the reduced light distribution accuracy is likely to be out of an allowable range of the headlamp. In particular, such an error may worsen the light distribution accuracy in an area having high light intensity in the light distribution.

Conventionally, when configuring a light source, that is, when mounting a plurality of LEDs on a substrate, the mounting operation is therefore required to be performed with high accuracy, which makes the mounting operation troublesome. Moreover, the mounting operation requires skill. For example, when mounting LEDs on a substrate, a reference hole is formed at a reference position in a part of the substrate, and the substrate is positioned by fitting this reference hole on a reference positioning pin provided on a workbench, and then the LEDs are sequentially mounted on the substrate. Even if the LEDs are mounted by this method, those LEDs which are mounted at the positions away from the reference hole change in position relative to the reference hole due to thermal deformation etc. of the substrate which occurs after mounting of the LEDs, and this causes an error of the mount positions of the LEDs. Accordingly, if the substrate is attached to the optical member by using the reference hole, those LEDs which are located away from the reference hole have larger errors of the attachment positions to the optical member than those LEDs which are located close to the reference hole. The resultant headlamp thus manufactured does not have light distribution characteristics as designed. In order to eliminate such an error of the mount positions of the LEDs, the mounting operation of the LEDs need be performed in consideration of deformation of the substrate, or in consideration of an error of attachment to the optical member, etc. This makes accuracy control in the mounting operation troublesome and difficult, and increases manufacturing cost of light sources or manufacturing cost of lamps.

One or more embodiments of the present invention provides a vehicular lamp unit that reduces manufacturing cost of a light source or manufacturing cost of a lamp by simplifying the operation of mounting light-emitting elements on a substrate.

According to one or more embodiments of the present invention, a vehicular lamp unit, including: a light source having a plurality of light-emitting elements arranged and mounted on a substrate; and an optical element having the light source attached thereto, for radiating emitted light of the light-emitting elements to a front of a vehicle with desired light distribution is characterized in that the substrate is long in a first direction, a reference portion serving as a positioning reference for the optical element is provided in a part of the substrate, the plurality of light-emitting elements are arranged in the first direction, the light-emitting element that illuminates an area having high light intensity of the light distribution is mounted at a position closer to the reference portion in the first direction than the light-emitting element that illuminates an area having low light intensity of the light distribution is.

In one or more embodiments of the present invention, the plurality of light-emitting elements are arranged at a predetermined interval in the first direction, and are arranged at respective set distances from the reference portion in a second direction that is perpendicular to the first direction. In one or more embodiments of the present invention, the light distribution is low-beam distribution, and the area having high light intensity is an area located in proximity of an optical axis of the low-beam distribution or an area that is in contact with a cut-off line. In one or more embodiments of the present invention, the light-emitting element that illuminates the area having high light intensity includes a light-emitting element that provides illumination with high-beam distribution.

According to one or more embodiments of the present invention, the light-emitting element that is mounted at a position close to the reference portion illuminates the area having high light intensity of the light distribution, and the light-emitting element that is mounted at a position away from the reference portion illuminates the area having low light intensity of the light distribution. Accordingly, the light-emitting element located away from the reference portion hardly affects light distribution even if an error is caused in the mount position of the light-emitting element due to deformation of the substrate etc. which occurs after mounting of the light-emitting elements and the attached position of the light-emitting element to the optical element such as a reflector is shifted. Accordingly, the level of accuracy required for mounting the light-emitting elements on the substrate can be lowered. This can make it easier to perform the mounting operation, can reduce the cost required for the mounting operation, and can reduce the cost for light sources or lamps.

DETAILED DESCRIPTION

Figure 1:
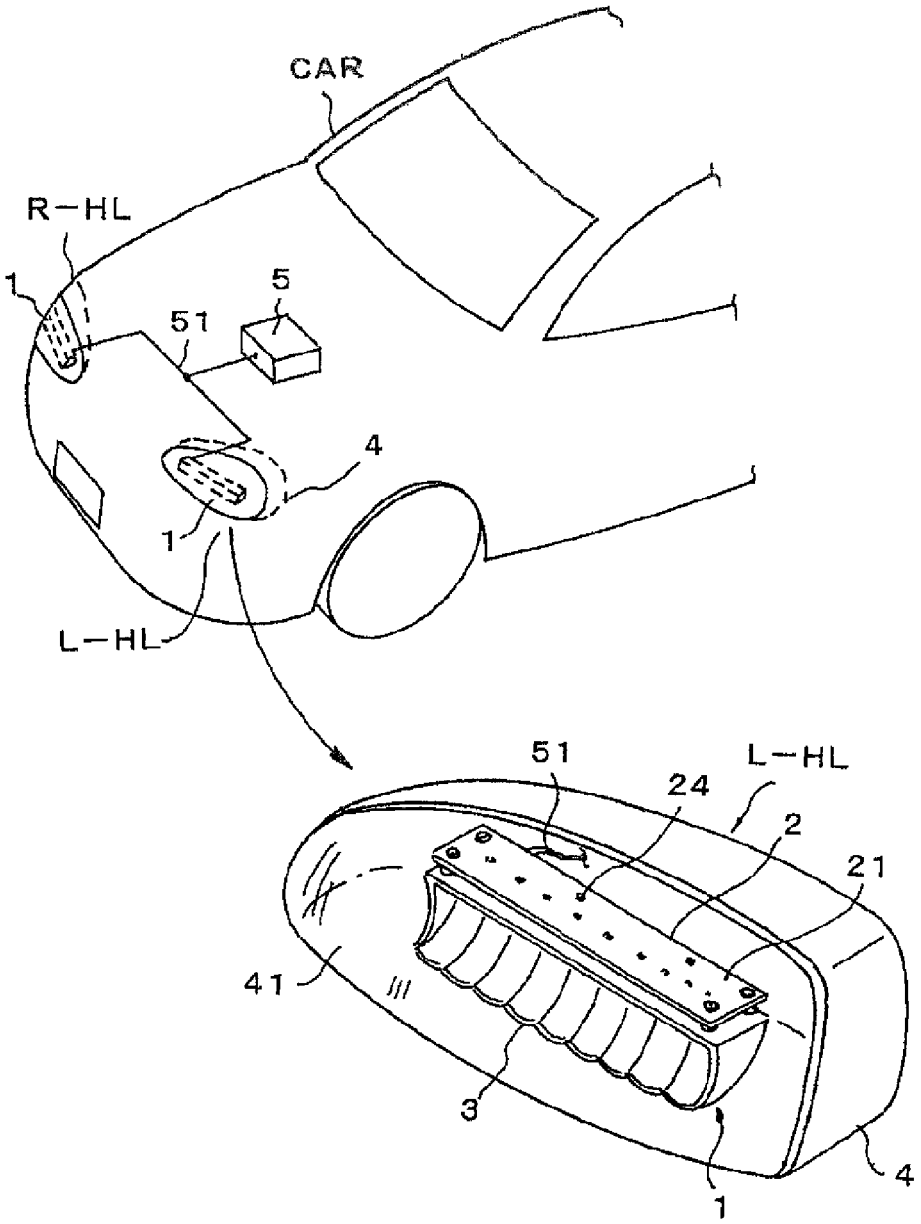
FIG. 1 is a schematic perspective view of an automobile having mounted thereon a headlamp having a lamp unit according to one or more embodiments of the present invention.

Embodiments of the present invention will be described with reference to the accompanying drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIG. 1 is a perspective view showing a conceptual configuration which a lamp unit according to one or more embodiments of the present invention is applied to headlamps (headlamps) of an automobile. Headlamps L-HL, R-HL are placed on the right and left front parts of a vehicle body of an automobile CAR. In these headlamps L-HL, R-HL, a lamp unit 1 is placed in a lamp housing 4 whose front surface is formed by a translucent cover 41, as a schematic configuration of the left headlamp L-HL is shown in the figure. This lamp unit 1 is formed by a light source 2 mainly formed by a substrate 21, and a multi-faced reflector 3 as an optical member. The lamp unit 1 reflects emitted light from the light source 2 forward by the multi-faced reflector 3, and transmits the reflected light through the translucent cover 41 to illuminate a region ahead of the automobile. The light source 2 is connected to an electronic circuit unit (ECU) 5 through a harness 51, and the ECU 5 switches between high-beam distribution and low-beam distribution to perform light distribution control. The ECU 5 is normally configured as a lamp ECU that performs lighting control of not only the headlamps L-HL, R-HL but also other lamps.

Figure 2:
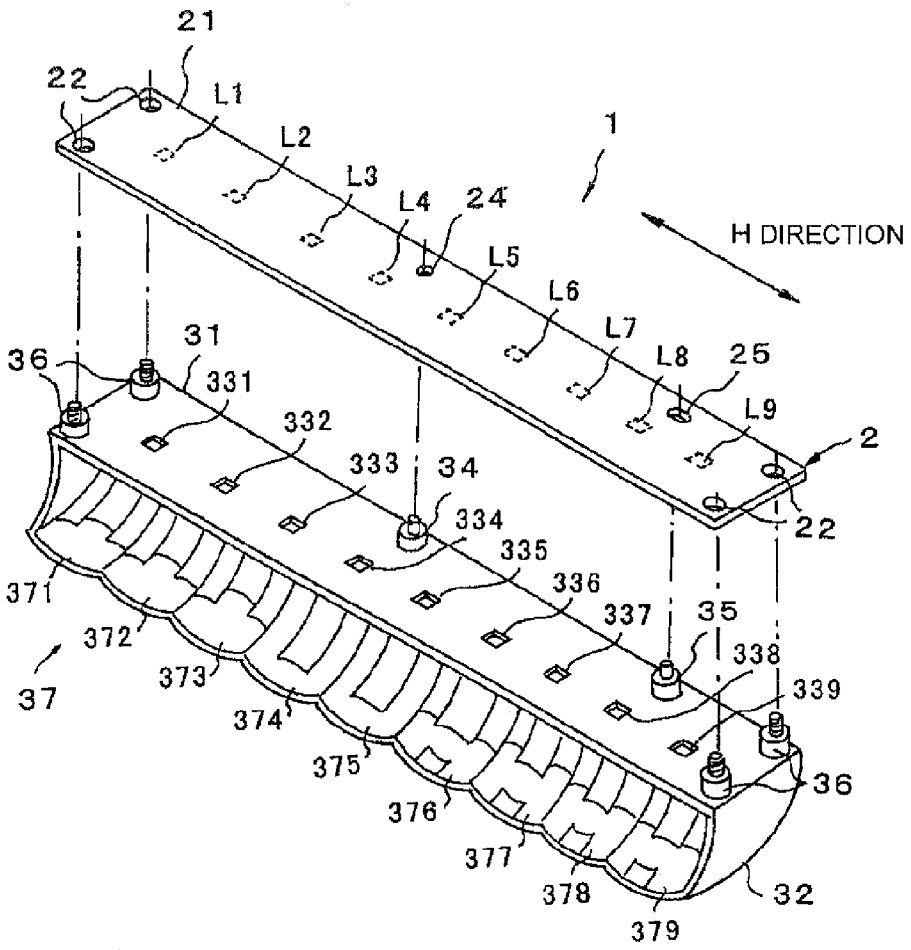
FIG. 2 is an exploded perspective view of the lamp unit of FIG. 1.

FIG. 2 is an exploded perspective view of the lamp unit 1. In the light source 2, a plurality of light-emitting elements, i.e., nine LEDs L1 to L9 in this example, are mounted on the single substrate 21. The substrate 21 is a rectangular substrate that is elongated in the horizontal lateral direction. The chip-like LEDs L1 to L9 are mounted on the front surface of the substrate 21, which faces downward in FIG. 2, such that their light emission optical axes (light emission optical axes) extend in a direction perpendicular to the front surface of the substrate 21 (downward in the figure). The substrate 21 has fixing holes 22 in four corners in order to fix the substrate 21 to the multi-faced reflector 3. In this example, the substrate 21 further has a first reference hole 24 with a small diameter, which is formed in a part of the substrate 21 as a reference portion that is used to position the substrate 21 with respect to the multi-faced reflector 3 when attaching the substrate 21 to the multi-faced reflector 3. In one or more embodiments of the present invention, the substrate 21 further has a second reference hole 25. The substrate 21 of the light source 2 is fixed to an upper part of the multi-faced reflector 3 such that the front surface of the substrate 21 having the LEDs L1 to L9 mounted thereon faces downward.

Figure 3:
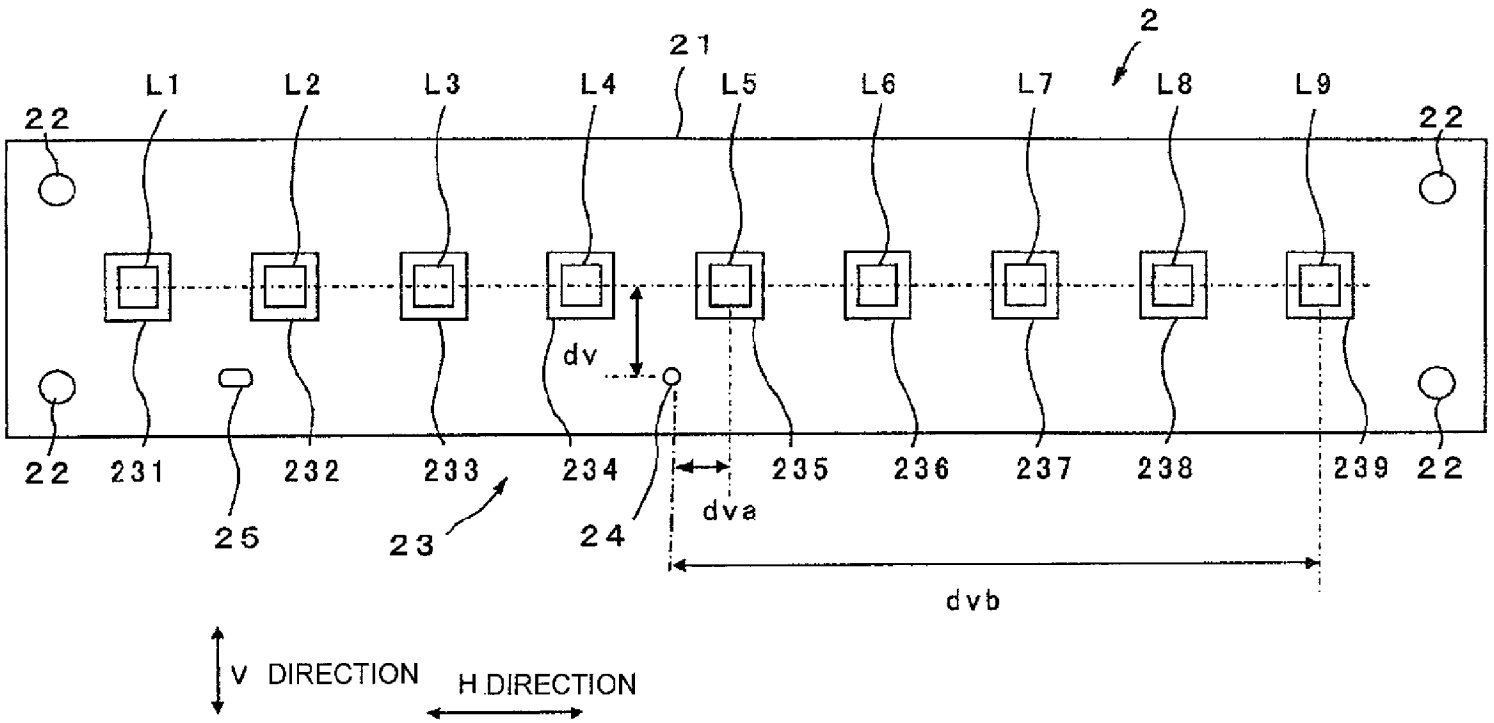
FIG. 3 is a plan view of a substrate as viewed from the front surface side thereof.

FIG. 3 is a plan view of the substrate 21 as viewed from the front surface side thereof (from below in FIG. 2). The fixing holes 22 are formed in the four corners of the rectangular substrate 21 that is elongated in the horizontal lateral direction. A conductive pattern, not shown, is formed on the front surface of the substrate 21. Nine LED lands 23 (231 to 239) on which the LEDs L1 to L9 are mounted are formed by a part of the conductive pattern. The nine LED lands 23 (231 to 239) are linearly arranged at desired pitch intervals in the longitudinal direction of the substrate 21 (the first direction in one or more embodiments of the present invention; hereinafter referred to as the "H direction"). The first reference hole 24 is formed in the substrate 21 so as to extend in the thickness direction thereof at a position that is located substantially at the center in the H direction and that is separated by a desired distance in a direction perpendicular to the H direction (the second direction in one or more embodiments of the present invention; hereinafter referred to as the "V direction") from the position where the LED lands 23 (231 to 239) are arranged. In other words, the nine LED lands 23 (231 to 239) are arranged based on the first reference hole 24, and each LED land 23 (231 to 239) is placed at predetermined distances in the H direction and the V direction from the first reference hole 24. The second reference hole 25 is formed at a position that is the same position in the V direction as that of the first reference hole 24 and that is close to the LED lands 231, 232. This second reference hole 25 improves accuracy of the dimension in the V direction of each LED land 23 (231 to 239). The LEDs L1 to L9 are thus mounted on the LED lands 23 (231 to 239), respectively. As described above, the LEDs L1 to L9 are mounted on the LED lands 23 (231 to 239) such that the optical axes of light emitted from light-emitting surfaces of the LEDs L1 to L9 extend in the direction perpendicular to the front surface of the substrate 21. The substrate 21 is attached to the multi-faced reflector 3 via the fixing holes 22 such that its front surface faces downward. Light emitted from each of the LEDs L1 to L9 is directed toward the multi-faced reflector 3 located vertically below the LEDs L1 to L9.

The multi-faced reflector 3 is formed by an elongated top board portion 31 extending in the horizontal lateral direction along the H direction as shown in FIG. 2, and a reflecting portion 32 that is extended downward from one edge of the top board portion 31, i.e., the edge facing the rear of the headlamp HL, and is further extended in a curved manner toward the front of the headlamp HL. The top board portion 31 has openings 33 (331 to 339) with a desired shape, which are formed at desired pitch intervals in the longitudinal direction so as to correspond to the nine LEDs L1 to L9, i.e., at the same pitch intervals as those at which the LEDs L1 to L9 are mounted. Positioning pins 34, 35 that are respectively fitted in the first and second reference holes 24, 25 of the substrate 21 stand on the upper surface of the top board portion 31 at substantially central positions in the longitudinal direction thereof. Fixing bosses 36, which are different from the positioning pins 34, 35, and whose lower ends are formed as cylindrical bosses and whose upper ends are formed as threaded portions, stand on four corners of the top board portion 31.

The reflecting portion 32 is divided into nine regions in the longitudinal direction so as to correspond to the nine openings 33 (331 to 339) of the top board portion 31, respectively. Each of the nine regions is formed as a paraboloid of revolution having a concave shape opening upward, or a curved surface approximated thereto, and the nine regions are formed as unit reflective surfaces 37 (371 to 379). In one or more embodiments of the present invention, each of the unit reflective surfaces 37 (371 to 379) is a collection of a plurality of very small reflective surfaces whose curvatures and whose positions of centers of curvatures are slightly different from each other. Each of the unit reflective surfaces 37 (371 to 379) is therefore a light reflective surface having its unique optical axis direction and light distribution characteristics. Each pair of the opening 33 of the top board portion 31 and its corresponding unit reflective surface 37 forms a unit reflector. Accordingly, in one or more embodiments of the present invention, nine unit reflectors are formed by the nine openings 331 to 339 and the nine unit reflective surfaces 371 to 379, and these unit reflectors are integrated to form the multi-faced reflector 3.

Figure 4:
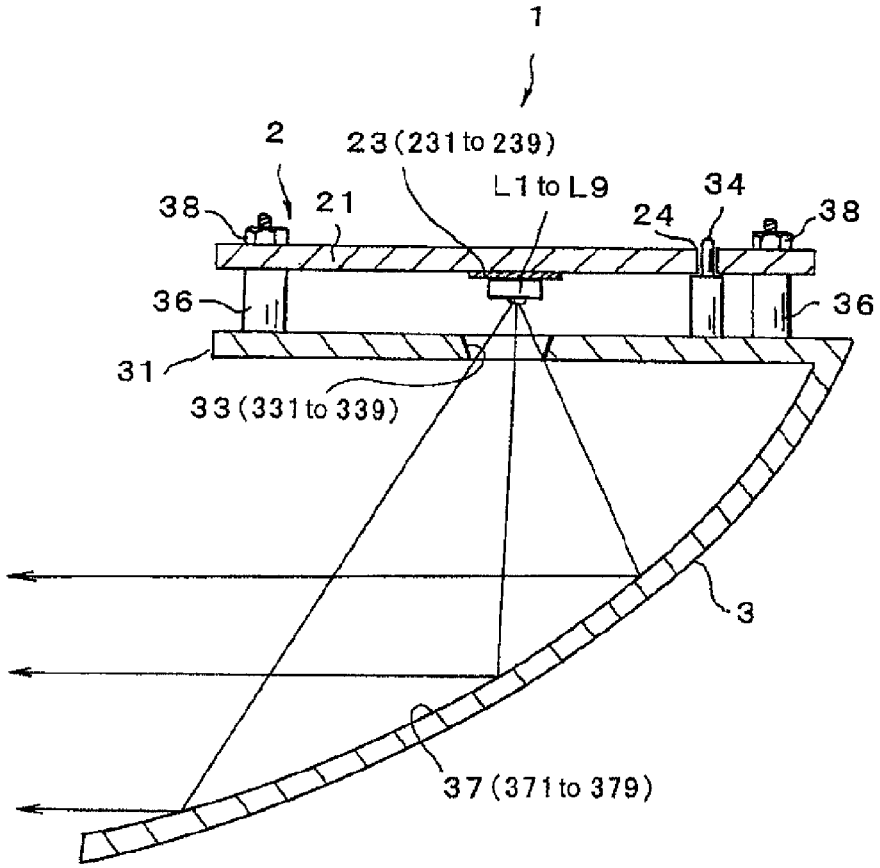
FIG. 4 is a longitudinal sectional view of the lamp unit in an assembled state.

As shown in the longitudinal sectional view of the lamp unit 1 in the assembled state in FIG. 4, the substrate 2 of the light source 1 is placed above the top board portion 31 of the multi-faced reflector 3 such that the front surface of the substrate 21 faces downward, namely the surface of the substrate 21 on which the LEDs L1 to L9 are mounted faces downward, and the substrate 21 is fixed to the top board portion 31. At this time, the fixing bosses 36 of the top board portion 31 are inserted through the fixing holes 22 provided in the substrate 21, and nuts 38 that screw on the threaded portions of the fixing bosses 36 are tightened, whereby the substrate 21 is fixed to the top board portion 31 so as to be separated by the height dimension of the fixing bosses 36. At the same time, the positioning pins 34, 35 are inserted through the first and second reference holes 24, 25 of the substrate 21. The substrate 21 is thus positioned with respect to the top board portion 31 in a planar direction, namely in the H direction and the V direction. With the substrate 21 being thus fixed to the top board portion 31, the nine LEDs L1 to L9 mounted on the substrate 21 are positioned so as to face the nine openings 331 to 339 of the top board portion 31, respectively. There is no play (backlash) in the V direction and the H direction between the first reference hole 24 and the positioning pin 34. However, since the second reference hole 25 is a hole that is long in the H direction, there is no play in the V direction between the second reference hole 25 and the positioning pin 35, but there is slight play in the H direction therebetween.

In the lamp unit 1 in which the substrate 21 is thus fixed to the top board portion 31 of the multi-faced reflector 3, when light is emitted from the nine LEDs L1 to L9, the emitted light of each LED L1 to L9 is reflected forward by a corresponding one of the unit reflectors. Referring to FIG. 4, the light emitted downward in the vertical direction from the LEDs L1 to L9 is respectively reflected forward in the horizontal direction by the unit reflectors (unit reflective surfaces; the same applies to the following description) 37 after passing through the openings 33. The reflected light is transmitted through the translucent cover 41 of the lamp housing 4, and then illuminates a region ahead of the automobile CAR. In this case, appropriately designing the curved surface shape of the nine unit reflectors 371 to 379 of the multi-faced reflector 3 allows the direction, diffusion, or concentration of the light that is emitted from each unit reflector 371 to 379 to be adjusted appropriately. Accordingly, the light reflected by the unit reflectors 371 to 379 respectively illuminates desired areas of the region ahead of the automobile, and the illumination light beams in these areas are superimposed on each other, whereby desired light distribution is obtained.

Figure 5A:
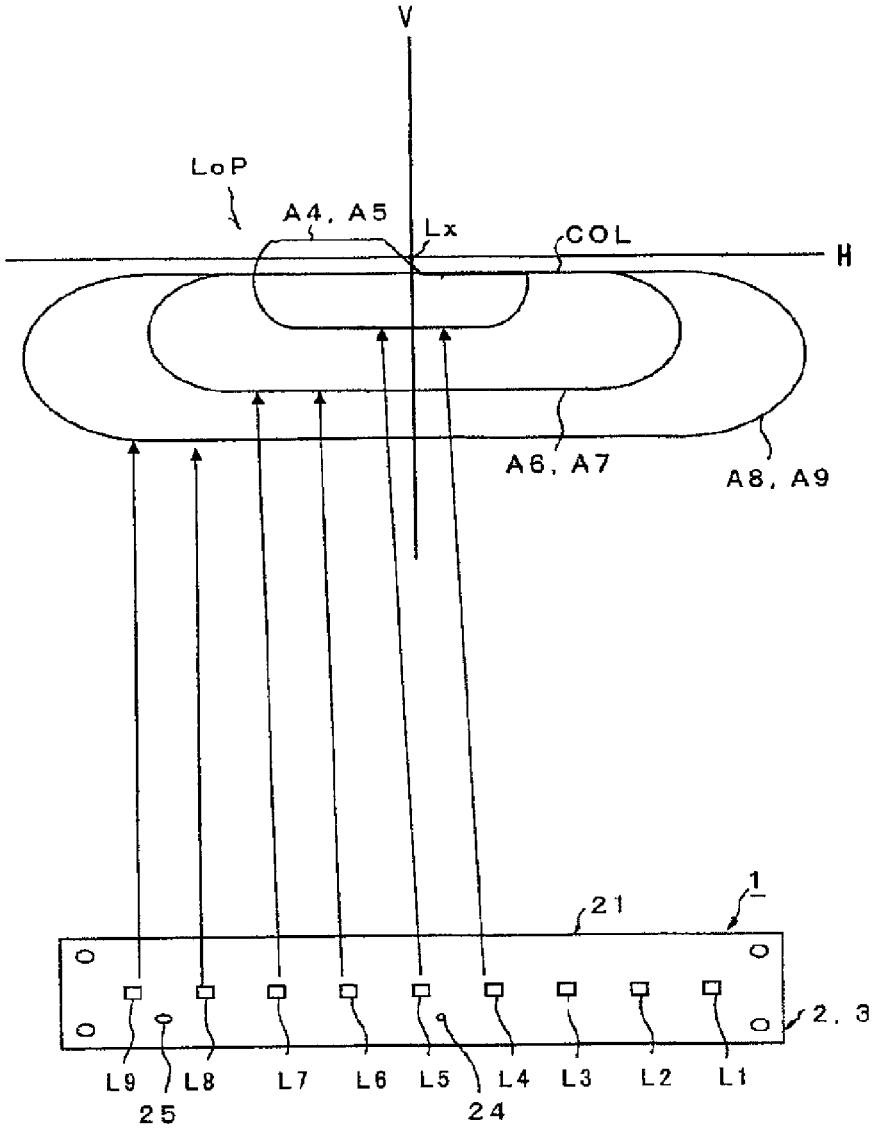
FIG. 5A is a diagram showing low-beam distribution characteristics of the lamp unit.

In one or more embodiments of the present invention, three of the unit reflectors 371 to 379 of FIG. 2 which are located on the inner side in the lateral direction of the automobile CAR (the left side in FIG. 2; hereinafter simply referred to as the "inner side"), namely the unit reflectors 371 to 373, are configured as unit reflectors for high-beam distribution, and six of the unit reflectors 371 to 379 of FIG. 2 which are located on the outer side in the lateral direction of the automobile CAR (the right side in FIG. 3; hereinafter simply referred to as the "outer side"), namely the unit reflectors 374 to 379, are configured as unit reflectors for low-beam distribution. Accordingly, as the correlation between light distribution patterns of low-beam distribution and the LEDs L4 to L9 is schematically shown in FIG. 5A, when the outer six LEDs L4 to L9 emit light, the outer six unit reflectors 374 to 379 illuminate areas A4 to A9, respectively, and illumination light beams in these six areas A4 to A9 are superimposed on each other, whereby low-beam distribution LoP having a cut-off line COL is obtained. At this time, the openings 334 to 339 of the unit reflectors 374 to 379 corresponding to the six LEDs L4 to L9 serve as shades that block a part of light that is emitted from the LEDs L4 to L9, respectively, and the cut-off line COL in the low-beam distribution LoP is formed by appropriately designing the edges of especially the two openings 334, 335.

Figure 5B:
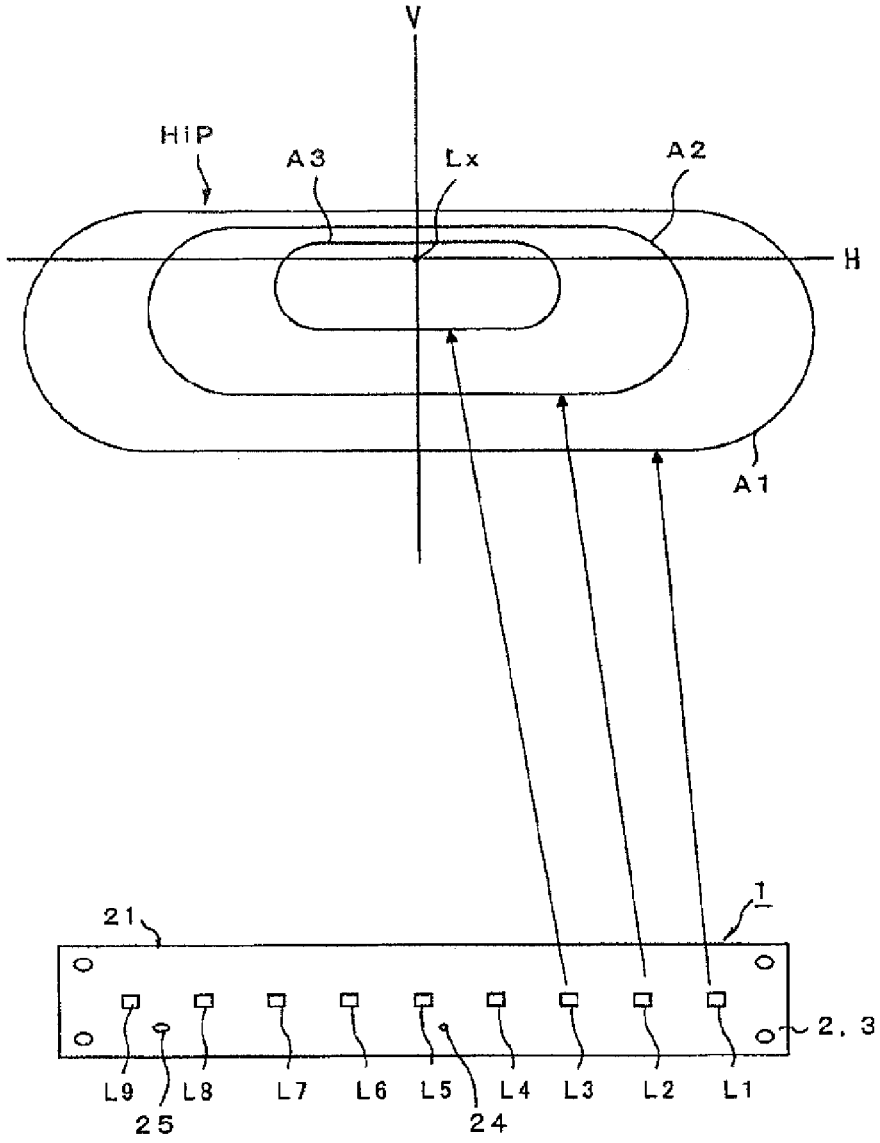
FIG. 5B is a diagram showing high-beam distribution characteristics of the lamp unit.

As shown in FIG. 5B, if light is emitted from the inner three LEDs L1 to L3, the three unit reflectors 371 to 373 corresponding to these LEDs L1 to L3 illuminate areas A1 to A3 including an area located above the cut-off line COL of the low-beam distribution LoP, respectively, and illumination light beams in these areas A1 to A3 are superimposed on each other, whereby high-beam distribution HiP is formed as a whole.

The low-beam distribution LoP and the high-beam distribution HiP are formed by the nine LEDs L1 to L9 as described above. In particular, when forming the low-beam distribution LoP, two of the outer six LEDs L4 to L9 which are placed at shorter distances in the H direction from the first reference hole 24 of the substrate 21 than the other LEDs, namely the LEDs L4, L5, are designed as light sources that illuminate the areas A4, A5 which are located in the proximity of a lamp optical axis Lx, in which the highest light distribution accuracy is required in the low-beam distribution LoP, which have high light intensity, and which form the cut-off line COL. On the other hand, the remaining four LEDs L6 to L9 located away from the first reference hole 24 are designed to illuminate the peripheral areas A6 to A9 such as the lower area and the left and right areas in the low-beam distribution LoP, in which such high light intensity as that of the two LEDs L4, L5 is not required.

Referring back to FIG. 3, the nine LEDs L1 to L9 that are mounted on the substrate 21 are arranged in line in the H direction as the longitudinal direction of the substrate 21. Accordingly, the distance dv in the V direction from the first reference hole 24 is the same for the nine LEDs L1 to L9, and this distance dv is designed to be as short as possible within the range in which required wiring spaces in the substrate 21 and light beams emitted from the LEDs L1 to L9 do not interfere with each other. Accordingly, even if the LEDs L1 to L9 are mounted on the substrate 21, the LEDs L1 to L9 are less likely to be subjected to thermal deformation of the substrate, deformation of the substrate with time, etc. which occurs after mounting of the LEDs L1 to L9 on the substrate 21, and the positions in the V direction of the LEDs L1 to L9 can be maintained with high accuracy. This V direction corresponds to the vertical direction in the light distribution that is formed by light reflection by each unit reflector 371 to 379. Accordingly, in the low-beam distribution LoP, the positions in the V direction of the outer six LEDs L4 to L9 with respect to the openings 334 to 339 of the unit reflectors 374 to 379 can be maintained with high accuracy, and high accuracy can be achieved for the height direction of the areas A4 to A9 of the low-beam distribution LoP which are formed by blocking a part of light from the LEDs L4 to L9 through the openings 334 to 339.

Of the outer six LEDs L4 to L9 that are mounted on the substrate 21, the two LEDs located closer to the first reference hole 24, namely the LEDs L4, L5 placed at short distances in the H direction from the first reference hole 24, are less likely to be subjected to thermal deformation of the substrate 21, deformation of the substrate 21 with time, etc. which occurs after mounting of the LEDs on the substrate 21, and the positions in the H direction of the two LEDs L4, L5 can be maintained with higher accuracy than the remaining four LEDs. That is, the distance dha in the H direction in FIG. 3 can be maintained with higher accuracy than the distance dhb in the H direction. The H direction extends in the horizontal direction of light that is reflected by the unit reflectors 374 to 379, and the areas A4, A5 resulting from radiation of light from the two LEDs L4, L5 are the areas that are located in the proximity of the optical axis Lx of the low-beam distribution LoP, and that are in contact with the cut-off line COL and have high light intensity. Accordingly, high accuracy can be achieved for the positions in the horizontal direction of these areas A4, A5, whereby a tilted part of the cut-off line COL which is formed in the proximity of the optical axis Lx of the low-beam distribution LoP can be formed with high accuracy, and the area A4 in the proximity of the optical axis extending in a straight traveling direction of the automobile can be illuminated with high accuracy.

On the other hand, each of the remaining four LEDs L6 to L9 of the outer six LEDs has a longer distance dhb in the H direction from the first reference hole 24 than the two LEDs L4, L5. Accordingly, these four LEDs L6 to L9 tend to be subjected to thermal deformation of the substrate 21, deformation of the substrate 21 with time, etc. which occurs after mounting of the LEDs L6 to L9 on the substrate 21, and the accuracy with which the positions in the H direction of the LEDs L6 to L9 are maintained tends to be reduced. However, the areas A6 to A9 resulting from radiation of light from the four LEDs L6 to L9 are the peripheral areas in the low-beam distribution LoP. Accordingly, a shift in positions of the areas A6 to A9 in the H direction, i.e., the horizontal direction hardly affects illumination in the area in the proximity of the cut-off line COL or the optical axis Lx in the low-beam distribution LoP, and is substantially negligible.

The same applies to the inner three LEDs L1 to L3 that provide illumination with high-beam distribution. These LEDs L1 to L3 illuminate a wide area including an area located above the cut-off line COL of the low-beam distribution LoP. Regarding the V direction, like the outer six LEDs L4 to L9, each of the LEDs L1 to L3 has a short distance dv in the V direction from the first reference hole 24 and the second reference hole 25. The positions in the V direction of the LEDs L1 to L3 therefore hardly change after mounting of the LEDs on the substrate. Since these three LEDs L1 to L3 illuminate a wide area in the horizontal direction, a small amount of change in mount position in the H direction of the LEDs L1 to L3 rarely causes a problem, and is negligible. The accuracy of the mount positions in the H direction therefore rarely matters even if the three LEDs L1 to L3 are mounted at the positions away from the first reference hole 24 in the H direction. However, even in this case, the accuracy of light distribution in the area located in the proximity of the optical axis Lx can be improved by designing the LED L3 located closest to the first reference hole 24 so that the LED L3 illuminates the area A3 located in the proximity of the optical axis Lx and having high light intensity.

As described above, regarding those LEDs which are mounted on the substrate 21 at the positions away from the first reference hole 24, even if an error in the mount positions of the LEDs L1 to L9, especially a shift in positions of the LEDs L1 to L9 with respect to the multi-faced reflector 3, is caused by deformation of the substrate 21 etc. which occurs after mounting of the LEDs L1 to L9 on the substrate 21, or even if a change in mount positions (positional error) of the LEDs L1 to L9 is caused in the case where the substrate 21 is attached to the multi-faced reflector 3 by using the first reference hole 24 as a reference position, such an error hardly affects light distribution. Accordingly, when mounting the LEDs L1 to L9 on the substrate 21, all the LEDs L1 to L9 need only be mounted with normal accuracy, and a change in position after mounting of the LEDs L1 to L9 on the substrate 21 need not be considered. This eliminates the need for an operation that is performed to ensure the accuracy higher than necessary when performing the operation of mounting the LEDs L1 to L9, and thus can reduce the cost required for the mounting operation and can reduce the cost of light sources.

By thus forming the light source 2 in which the mount positions of the LEDs L1 to L9 are set in view of the light distribution, according to experiments of the inventor, the positional accuracy was normally controlled in the V direction when mounting the LEDs L1 to L9 on the LED lands 23 formed on the substrate 21. Regarding the H direction, however, it was confirmed that desired light distribution was obtained even if the LED was mounted with a margin of about 0.1 mm in the dimension in the H direction on the LED land 239 located farthest in the H direction from the first reference hole 24. This also eliminates the need to increase the level of accuracy required for the operation of mounting those LEDs which are located away from the first reference hole 24 in the H direction, and thus can simplify the mounting operation to reduce the cost required for the mounting operation, and can reduce the cost of light sources. In particular, the accuracy in the V direction can be improved for the LEDs located away from the first reference hole 24 by controlling the positional accuracy by using the second reference hole 25 as well.

The left headlamp L-HL of the automobile is described above. In the case of the right headlamp R-HL, the configuration of the lamp unit 1, namely the configuration of the light source 2 and the multi-faced reflector 3, is symmetric to that in the left headlamp L-HL. However, since the cut-off line of the low-beam distribution LoP has the same shape both in the left and right headlamps L-HL, R-HL, the configuration of the outer six reflectors 374 to 379 of the multi-faced reflector 3, that is, the six unit reflectors that are located on the left side as viewed from the front in the case of the right headlamp R-HL, and the shape of the openings formed so as to correspond to these unit reflectors are the same in the lateral direction.

In one or more embodiments of the present invention, the inner three LEDs L1 to L3 are formed for high-beam distribution, and the outer six LEDs L4 to L9 are formed for low-beam distribution. However, the order of the level of positional accuracy that is required for the mount positions of the LEDs based on the accuracy and light intensity required for the illuminated areas, from the highest to the lowest, is (a) the areas located in the proximity of the optical axis of low-beam distribution or high-beam distribution, (b) the areas in contact with the cut-off line of the low-beam distribution, (c) the peripheral areas in the low-beam distribution, and (d) the peripheral areas in the high-beam distribution. Accordingly, the respective distances from the first reference hole 24 to the LEDs may be set according to this order of (a) to (d).

Figure 6A:
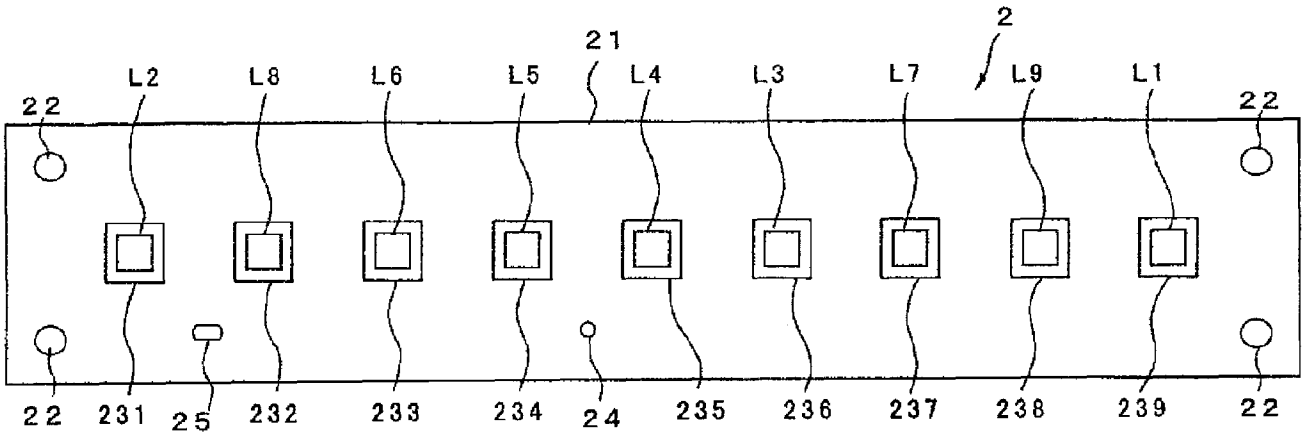
FIGS. 6A-6B show plan views showing different substrate examples as viewed from the front surface side thereof.

For example, although not shown in the figure, in the case where the multi-faced reflector 3 is designed so as to illuminate the desired light-distribution areas A1 to A9 by using all of L1 to L9, and the first reference hole 24 is formed in the center in the H direction of the substrate 21 as shown in FIG. 6A, the LEDs L4, L5, L3 for (a) are mounted at the positions located adjacent to the reference hole 24 in the H direction, the two respective LEDs L6, L7 for (b) are mounted on respective sides of the LEDs L4, L5, L3, and the LEDs L8, L9 for (c) are mounted on respective sides of the LEDs L6, L7. The LEDs L1, L2 for (d) are mounted on respective sides of the LEDs L8, L9.

Figure 6B:
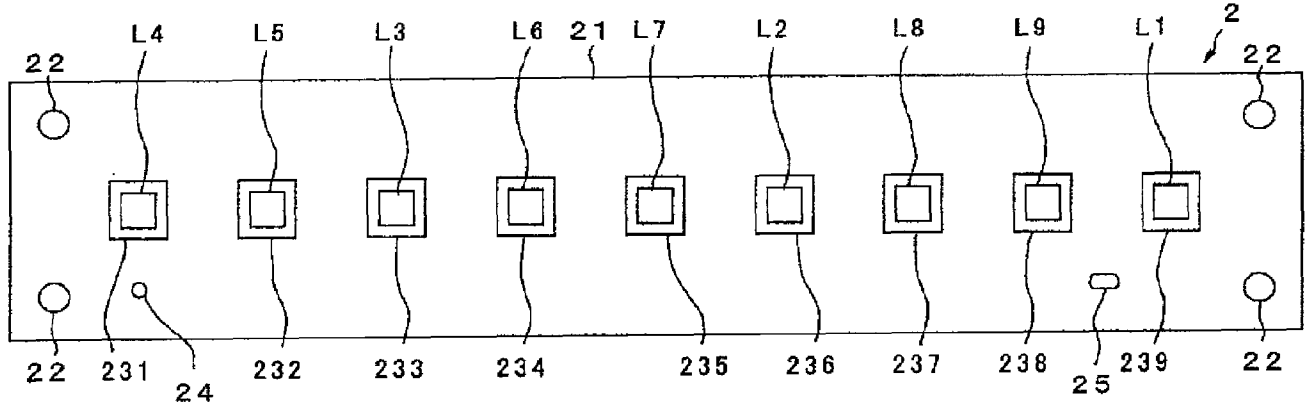

Alternatively, in the case where the first reference hole 24 is formed in one end in the longitudinal direction of the substrate 21 as shown in FIG. 6B, the LED L4 for (a) is placed on the one end of the substrate 21 at a position close to the reference hole 24, and the LEDs L5, L3, L6, L7, L2, L8, L9, L1 for (b) to (d) are arranged in this order toward the other end.

In both FIGS. 6A and 6B, as in one or more of the above embodiments, the areas A4, A5 in the proximity of the optical axis of the low-beam distribution LoP are illuminated by the LEDs L4, L5, the areas A6, A7 in contact with the cut-off line of the low-beam distribution LoP are illuminated by the LEDs L6, L7 arranged in line with the LEDs L4, L5, and the peripheral areas A8, A9 in the low-beam distribution LoP are illuminated by the LEDs L8, L9 arranged in line with the LEDs L4, L5, L6, L7. The areas A1 to A3 of the high-beam distribution HiP are illuminated by the LEDs L1 to L3. In these cases as well, the positional accuracy in the V direction of each LED can be improved by providing the second reference hole 25.

In one or more of the above embodiments, light emitted from the LEDs L1 to L9 is reflected in the forward direction at substantially 90 degrees to the vertical direction by the multi-faced reflector 3 that is formed by the plurality of unit reflectors arranged next to each other in the horizontal direction, thereby providing illumination. Accordingly, the substrate 21 is long in the H direction along the horizontal direction, and the LEDs L1 to L9 are mounted on the substrate 21 so as to be arranged in the H direction. The reason for this is as follows. In low-beam distribution and high-beam distribution, tolerance of error in the mount positions of the LEDs in the horizontal direction can be made large as the illumination range is wide in the horizontal direction, but the accuracy of the mount positions of the LEDs need be relatively high in the vertical direction as the illumination range is narrow in the vertical direction. In one or more embodiments, the substrate 21 is long in the H direction along the horizontal direction. Accordingly, when the plurality of LEDs are arranged and mounted in the H direction, all the LEDs can be positioned in the V direction with high accuracy.

The optical element is not limited to the multi-faced reflector described in one or more of the above embodiments. For example, the optical element may be an optical member such as a reflector that provides illumination by reflecting emitted light of LEDs in a direction along an optical axis of light emission of the LEDs. Alternatively, the reflector may not be used, and the optical element may be an optical member such as a lens that concentrates or diffuses emitted light of LEDs after blocking a part of the light by a shade. In either case, in a lamp in which a plurality of LEDs are arranged and mounted on a single substrate that is long in the horizontal direction, and the substrate is attached to the optical member such as the reflector or the lens, mounting the LEDs so that all the LEDs are arranged in the horizontal direction can suppress a positional error in the vertical direction. For the horizontal direction, those LEDs for which required light distribution accuracy is high are mounted at positions close to the reference position for attaching the substrate, and those LEDs for which the required light distribution accuracy is low are mounted at positions away from the reference position.

The number of LEDs as light-emitting elements is not limited to nine as in one or more of the above embodiments, and the present invention is applicable to lamp units using a plurality of LEDs as a light source. In this case, the plurality of LEDs need not necessarily be arranged in line in the first direction, but the distances in the second direction from the reference hole to the LEDs may be set to predetermined distances, respectively. The reference portion in one or more embodiments of the present invention is formed by the reference hole. However, the reference portion in one or more embodiments of the present invention may be a reference recess that is formed by cutting out a part of the edge of the substrate, a reference protrusion that extends through and is fixed to a part of the substrate, a reference pattern that is used for optical positioning, etc.

One or more embodiments of the present invention can be used for vehicular lamps in which a light source is formed by mounting a plurality of light-emitting elements on a single substrate.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF THE REFERENCE NUMERALS

1 LAMP UNIT
2 LIGHT SOURCE
3 MULTI-FACED REFLECTOR (OPTICAL ELEMENT)
4 LAMP HOUSING
5 LAMP ECU
21 SUBSTRATE
22 FIXING HOLE
23 LED LAND
24 FIRST REFERENCE HOLE (REFERENCE PORTION)

25 SECOND REFERENCE HOLE
31 TOP BOARD PORTION
32 REFLECTING PORTION
33 OPENING
34, 35 POSITIONING PIN
37 UNIT REFLECTOR (UNIT REFLECTIVE SURFACE)
38 FIXING BOSS
L1 TO L9 LED (LIGHT EMITTING ELEMENT)
L-HL, R-HL HEADLAMP
H DIRECTION (FIRST DIRECTION: HORIZONTAL DIRECTION)
V DIRECTION (SECOND DIRECTION: VERTICAL DIRECTION)

The invention claimed is:

1. A vehicular lamp unit, comprising:
a flat substrate;
a light source comprising a first light-emitting element and a second light-emitting element disposed on the substrate; and
an optical element having the light source attached thereto,
wherein the substrate is long in a first direction,
wherein the optical element radiates emitted light of the first and second light-emitting elements toward a front of the vehicular lamp unit, with a desired light distribution,
wherein a reference portion serving as a positioning reference for the optical element is provided in a part of the substrate,
wherein the reference portion on the substrate engages with the optical element to position the substrate with respect to the optical element,
wherein the first and second light-emitting elements are arranged in the first direction,
wherein the first light-emitting element illuminates an area having high light intensity of the light distribution,
wherein the second light-emitting element illuminates an area having low light intensity of the light distribution, and
wherein the first light-emitting element is mounted at a position closer to the reference portion in the first direction than the second light-emitting element.

2. The vehicular lamp unit according to claim 1,
wherein the first and second light-emitting elements are arranged at a predetermined interval in the first direction, and are arranged at respective set distances from the reference portion in a second direction perpendicular to the first direction.

3. The vehicular lamp unit according to claim 1,
wherein the light distribution is low-beam distribution, and
wherein the area having high light intensity is an area located in proximity of an optical axis of the low-beam distribution or an area that is in contact with a cut-off line.

4. The vehicular lamp unit according to claim 1,
wherein the first light-emitting element provides illumination with high-beam distribution.

5. The vehicular lamp unit according to claim 1,
wherein the optical element comprises a multi-faced reflector in which unit reflectors corresponding to a number of light-emitting reflectors are integrally arranged in the first direction, and
wherein the optical element reflects emitted light of each of the first and second light-emitting elements by a corresponding one of the unit reflectors to radiate the reflected light.

6. The vehicular lamp unit according to claim 2,
wherein the light distribution is low-beam distribution, and
wherein the area having high light intensity is an area located in proximity of an optical axis of the low-beam distribution or an area that is in contact with a cut-off line.

7. The vehicular lamp unit according to claim 2,
wherein the first light-emitting element provides illumination with high-beam distribution.

8. The vehicular lamp unit according to claim 2,
wherein the optical element comprises a multi-faced reflector in which unit reflectors corresponding to a number of light-emitting reflectors are integrally arranged in the first direction, and
wherein the optical element reflects emitted light of each of the first and second light-emitting elements by a corresponding one of the unit reflectors to radiate the reflected light.

9. The vehicular lamp unit according to claim 3,
wherein the optical element comprises a multi-faced reflector in which unit reflectors corresponding to a number of light-emitting reflectors are integrally arranged in the first direction, and
wherein the optical element reflects emitted light of each of the first and second light-emitting elements by a corresponding one of the unit reflectors to radiate the reflected light.

* * * * *